United States Patent [19]

Trützschler

[11] 4,155,837

[45] May 22, 1979

[54] METHOD AND APPARATUS FOR CLEANING AND DUSTING TEXTILE FIBER TUFTS

[75] Inventor: Hermann Trützschler, Mönchen-Gladbach, Fed. Rep. of Germany

[73] Assignee: Trutzschler GmbH & Co. KG, Mönchen-Gladbach, Fed. Rep. of Germany

[21] Appl. No.: 862,044

[22] Filed: Dec. 19, 1977

[30] Foreign Application Priority Data

Dec. 18, 1976 [DE] Fed. Rep. of Germany ..... 2657602
May 5, 1977 [DE] Fed. Rep. of Germany ..... 2720190

[51] Int. Cl.[2] ..... B07B 4/08; B08B 5/02

[52] U.S. Cl. ..... 209/26; 209/136; 209/468; 134/37

[58] Field of Search ..... 209/26–29, 209/133–139 R, 468, 469, 475, 476, 250; 134/37, 21; 19/200, 205

[56] References Cited

U.S. PATENT DOCUMENTS

| | | | |
|---|---|---|---|
| 468,735 | 2/1892 | Woolcott | 209/29 |
| 1,574,384 | 2/1926 | Garner | 209/135 |
| 2,076,523 | 4/1937 | Ballack et al. | 209/468 X |
| 2,269,085 | 1/1942 | Morgan | 19/202 X |
| 2,651,812 | 9/1953 | Black | 209/136 X |
| 3,920,542 | 11/1975 | Laird et al. | 209/134 |

FOREIGN PATENT DOCUMENTS

| | | | |
|---|---|---|---|
| 953282 | 11/1956 | Fed. Rep. of Germany. | |
| 1510395 | 3/1972 | Fed. Rep. of Germany. | |
| 2426742 | 12/1975 | Fed. Rep. of Germany | 19/200 |
| 730149 | 5/1955 | United Kingdom. | |

*Primary Examiner*—Ralph J. Hill
*Attorney, Agent, or Firm*—Spencer & Kaye

[57] ABSTRACT

A method and apparatus for cleaning textile fiber tufts by depositing such textile fiber tufts onto the upper surface of a supporting member provided with openings, directing streams of compressed air upwardly through the openings in the member and against the textile fiber tufts from delivery nozzles arranged below the supporting member for propelling the tufts upwardly to release dust therefrom and permit heavy particles to be separated from the tufts and to fall through the openings in the supporting member; drawing away the released dust by means of a suction device disposed above the supporting member, and conveying the fiber tufts along the supporting member.

12 Claims, 5 Drawing Figures

METHOD AND APPARATUS FOR CLEANING AND DUSTING TEXTILE FIBER TUFTS

BACKGROUND OF THE INVENTION

The present invention relates to a method and apparatus for cleaning textile fiber flakes, or tufts, in which the textile fiber tufts are placed on the upper surface of an air-permeable supporting member, and which can be employed in connection with opening or picking of the textile material.

In a known process, a device for sucking away air from the bottom through a conveyor belt covered with fiber tufts is disposed at the side of the belt facing away from the fiber tufts. One drawback of this process is that it causes the tufts to be pulled firmly against the conveyor belt and the dust constituent may be sucked through the layer of fibers on the belt. A mechanical device is required to remove the resulting fleece from the belt which causes shortening of the staple fibers and matting.

SUMMARY OF THE INVENTION

It is an object of the present invention to increase the thoroughness with which dust is removed from textile fiber tufts while subjecting the fiber material to a gentle treatment.

These and other objects are achieved according to the invention by a method for cleaning textile fiber tufts which involves depositing such textile fiber tufts onto the upper surface of a supporting member provided with openings, directing streams of compressed air upwardly through the openings in the member and against the textile fiber tufts from delivery nozzles arranged below the supporting member for propelling the tufts upwardly to release dust therefrom and permit heavy particles to be separated from the tufts and to fall through the openings in the supporting member, and drawing away the released dust by means of a suction device disposed above the supporting member.

The supporting member is preferably a supporting table and due to the fact that air delivery nozzles are provided underneath the supporting table, the fiber material which is present on the supporting table will be whirled upwardly by the streams of compressed air. This blows the textile fiber tufts up and out, thus helping to open them up. The heavier waste components, e.g. seeds and pieces of shell, are the first to drop down again and are removed by passing through the openings in the supporting table. The dust released during the upward whirling of the fiber material floats in the space above the supporting table and is removed by the action of a continuous suction air stream produced by the suction device disposed above the supporting table. In this way it is possible to remove a significantly greater amount of dust than was heretofore possible, with the added advantage that the fiber material is treated gently so that, for example, shortening of the staple fibers and matting are avoided.

According to a preferred embodiment of the invention, streams of compressed air are discharged periodically from the delivery nozzles. Thus a plurality of pressure surges act on the textile fiber tufts within a short period of time, so that the opening-up phase, and thus the removal of the heavier waste and of the dust, is improved.

The objects according to the invention are also achieved by provision of an apparatus which includes a supporting member, particularly a supporting table, provided with openings having a width less than the size of the tufts, a device for delivering textile fiber tufts onto the upper surface of the member, a device disposed below the supporting member for directing surges of compressed air toward the supporting member and through the openings, in directions which are oblique to the upper surface of the supporting member, a perforated cover plate disposed to that side of the supporting member to which the tufts are supplied and located at a distance from the supporting member, and a device connected to the perforated cover plate for sucking air away from the member.

The "size" of each tuft is generally its smallest transverse dimension. Of course, the tufts supplied to the conveyor belt will vary in size over a certain range and the width of the openings should be smaller than the lower end of that range, the essential consideration being that tufts be prevented from falling through the openings.

Due to the fact that the openings in the conveyor belt are smaller in width than the size of the tufts, heavy waste, for example seeds and pieces of shell, can fall through the openings into a waste collecting area.

The combination of air delivery nozzles disposed below the supporting table and a suction device disposed above the supporting table so as to suck away the dust results in a structurally simple apparatus for practicing the above-described method. The delivery nozzles may extend into the openings of the supporting table, in which case the outlet openings of the delivery nozzles are positioned to be flush with the surface of the supporting table.

If the supporting table, e.g. driven by a shaking motor, is vibrated laterally, i.e. parallel to the plane of its upper surface, the heavier waste particles which drop down can be moved in a transverse direction, i.e. perpendicularly to the direction of movement of the fiber tufts, by a suitable conveying unit, and can be removed from there.

The device for directing surges of compressed air is advantageously composed of parallel pipes which are connected to a common pneumatic line. At their sides facing the supporting table, these pipes are advisably provided with a plurality of juxtaposed, spaced air delivery nozzles.

According to a preferred embodiment, the pipes extend perpendicular to the direction in which textile fiber tufts are conveyed along the table and the nozzles are all inclined in the same direction, with respect to the supporting table, i.e. in the direction of transport of the tufts along the table. In this way the textile fiber tufts are always driven from the region of one pipe to the next. The conveyance of the textile fiber tufts is improved, according to a particularly preferred embodiment, by orienting the delivery nozzles so that the inclination of their axes relative to the vertical increases progressively from one row of nozzles to the next in the transporting direction of the textile fiber tufts on the supporting table.

According to a further embodiment of the invention, the supporting table is given a vibratory movement in the direction in which fiber material is to be conveyed, the opening up of the fiber tufts and thus the separation of dust adhering thereto is effected by the surges of compressed air produced by the device provided for that purpose, and the latter device is connected to the supporting table and thus moves along with it. Coarse pieces of waste, such as pieces of shell or the like, drop down through the openings in the supporting table and are there removed while the dust released from the fiber tufts is extracted by means of the device for sucking away air. The particular advantage of this embodiment is that independent structural elements, i.e. the supporting table in the form of a conveying element and the compressed air delivery nozzles, respectively, are provided for the functions of fiber transport and opening up. As a result, each of these individual structural elements can be individually selected and constructed in the manner most favorable for its respective function of transporting or opening up.

Advisably the supporting table is caused to vibrate by eccentrically driven guides at a rate of, for example, 40 to 80 vibrations per minute.

Advantageously the supporting table is laterally delimited by walls, so that the supporting table has the shape of a conveying trough which assures that the fiber tufts will be conveyed exclusively in the desired conveying direction and that the heavy waste particles will drop only directly below the supporting table and can be removed from there.

DESCRIPTION OF THE PREFERRED EMBODIMENTS

Figure 1:
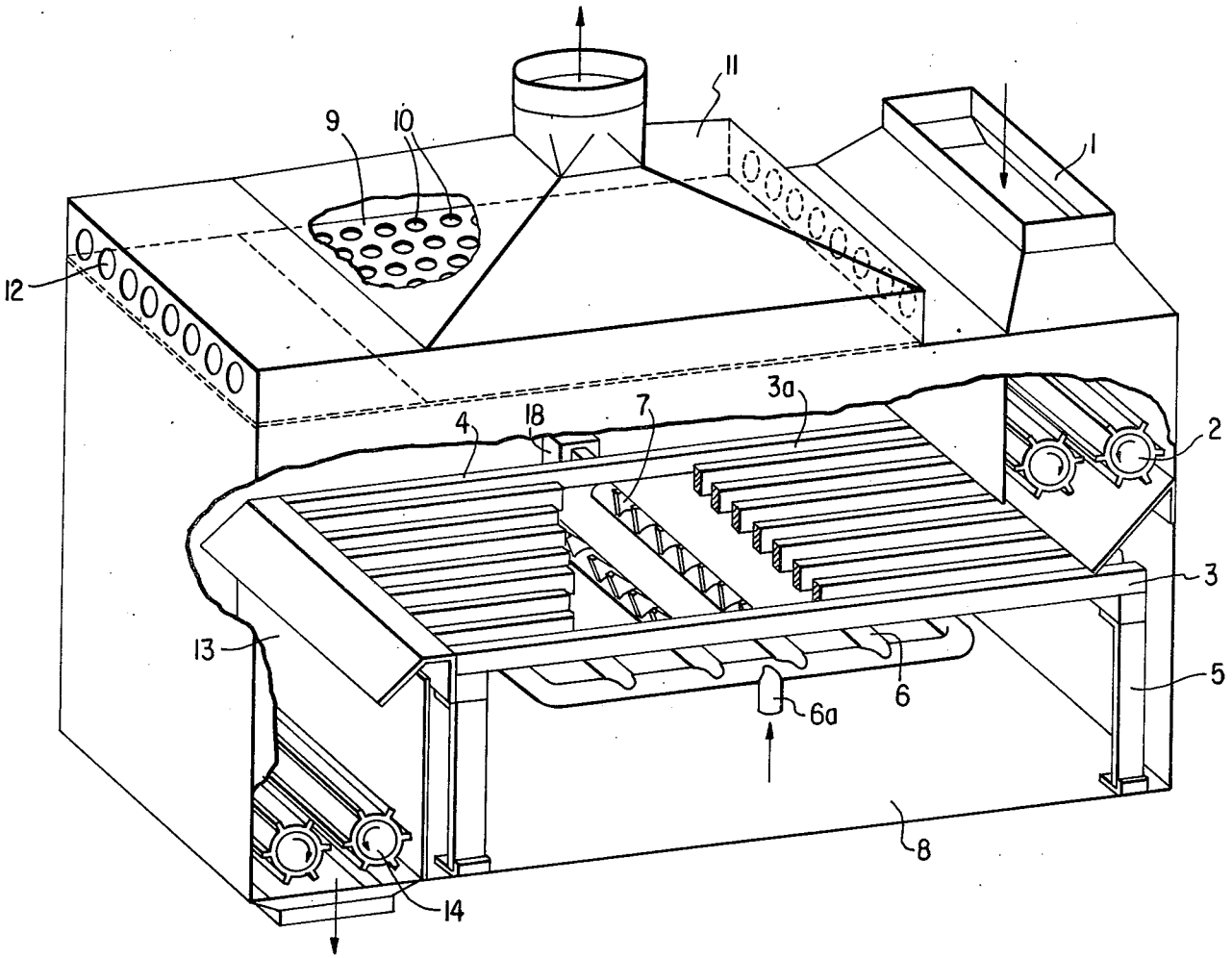
FIG. 1 is a perspective view partially cut away and partially in section, of one preferred embodiment of an apparatus according to the invention.

FIG. 1 shows an apparatus which includes a shaft 1 into which fiber material tufts are fed to be conveyed via two delivery rollers 2 to a supporting table 3. The supporting table 3 is composed of a plurality of parallel rods 4 extending in the direction in which the fiber tufts are to be conveyed. Rods 4 are spaced apart laterally to define openings 3*a* in the form of slits and the spacing between rods 4 is selected so that no tufts or spinnable fibers can fall through, but heavier pieces of waste can, and is, for example, 8 mm.

Leaf springs 5 are arranged at the corners of the rectangular supporting table 3 to support the supporting table 3 and to simultaneously permit a vibrating movement in a direction transverse to the transporting direction, produced by a standard vibration exciter 18 connected to the table.

In the area below the supporting table 3 a plurality of mutually parallel pipes 6 are arranged one behind the other in the direction in which textile fiber tufts are to be conveyed and are connected to a common compressed air inlet line 6*a*. On their side facing the supporting table 3, the pipes 6 are each provided with a plurality of juxtaposed, spaced air delivery nozzles 7. The nozzles 7 are arranged so that their axes are all inclined in the same direction with respect to the supporting table, and with progressively increasing inclinations to the vertical in the direction of conveyance of the textile fiber tufts.

Line 6*a* is connected to a compressed air source (not shown) in such a manner that pressure surges enter pipes 6 and nozzles 7 at periodic intervals, e.g. 2 surges per second. Thus the fibers are blown up and apart in the direction toward the perforated cover plate 9 which is disposed at a distance above the supporting table 3. In addition, the direction of the compressed air streams emanating from nozzles 7 serves to propel the textile material in the table conveying direction, which is parallel to rods 4. While the heavier waste particles then fall through the longitudinal slits 3*a* between adjacent rods 3 into the waste area 8, the dust liberated from the textile material is sucked by a suction ventilator (not shown) through the openings 10 of the perforated cover plate 9 into the removal area 11 and from there through a discharge line (not shown) connected to the outlet conduit associated with area 11.

A suction air regulator 12 is connected to the removal area 11 to permit the suction force to be varied by adjusting the extent to which the openings in regulator 12 are covered. The cleaned tufts move from the discharge side of the supporting table 3 into a discharge shaft 13 and are removed therefrom by means of removal rollers 14.

Figure 2:
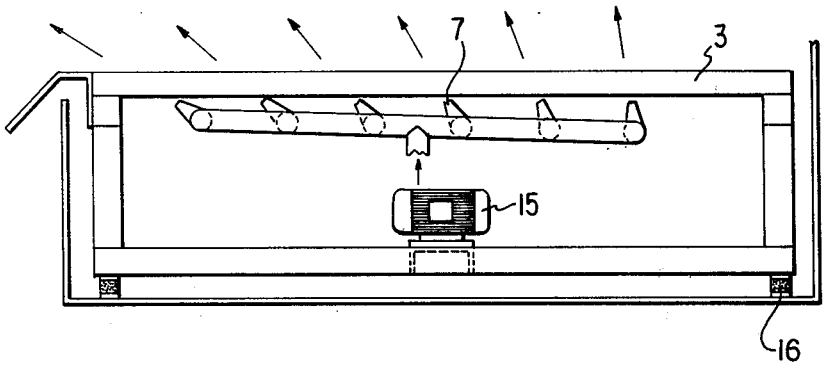
FIG. 2 is a side elevational view of the supporting table and compressed air delivery system of a modified version of the embodiment of FIG. 1.

FIG. 2 shows an embodiment in which the supporting table 3 and the underlying compressed air delivery system have substantially the same form as in FIG. 1, and shows more clearly how nozzles 7 are arranged with progressively increasing inclination with respect to the vertical in the direction of transport of the textile fiber tufts along table 3. However, in this embodiment the supporting table 3 is driven in a laterally vibrating manner by means of a vibrator motor 15 connected thereto and is supported by vibration dampening buffers 16 which attenuate the transmission of vibrations from table 3 to the supporting frame.

Figure 4:
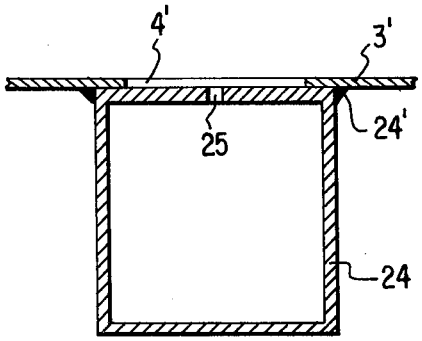
FIG. 4 is an elevational detail view of a component of the apparatus of FIG. 3 for emitting surges of compressed air at the supporting table.
Figure 3:
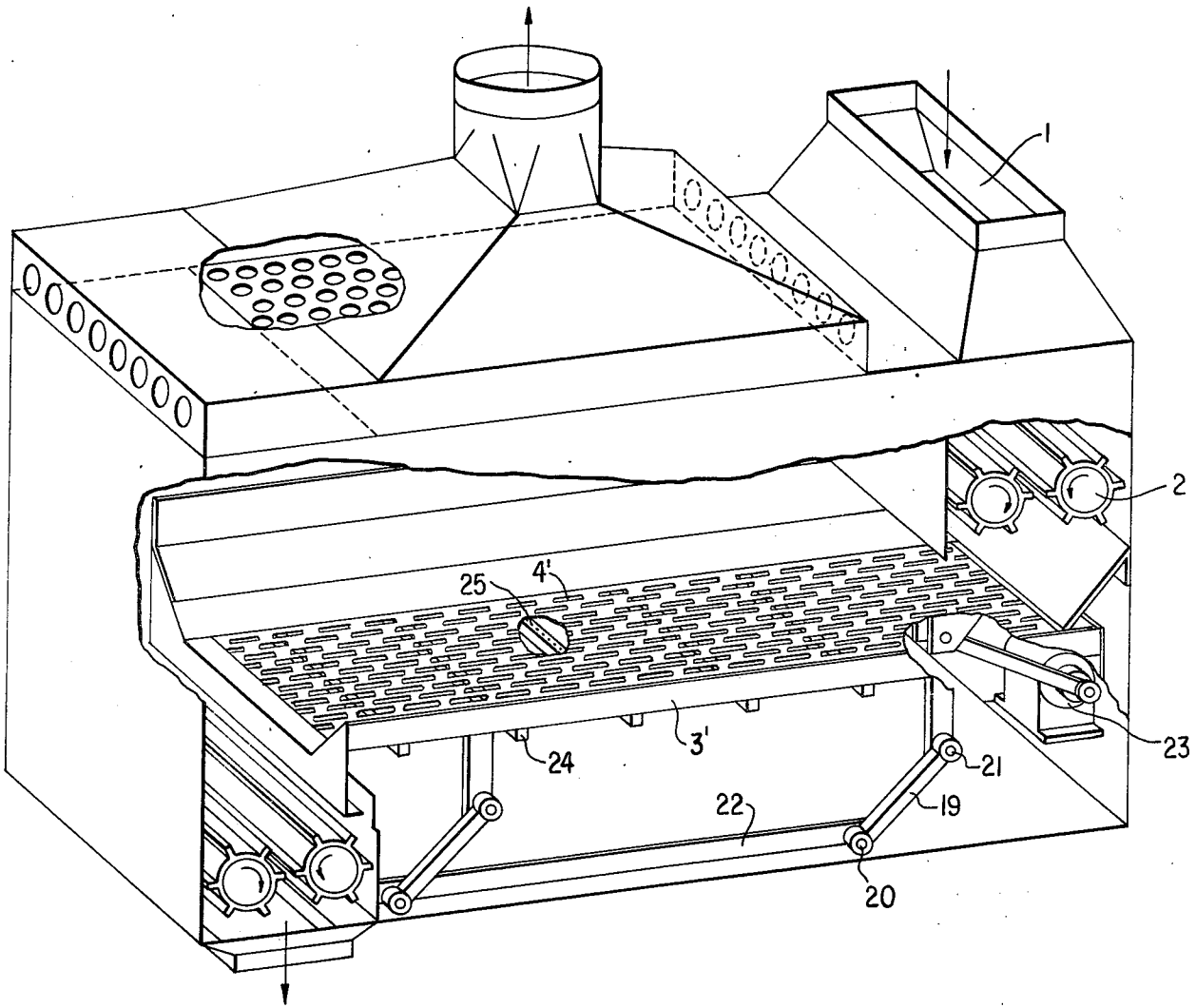
FIG. 3 is a perspective view, partially broken away of a further embodiment of an apparatus according to the invention.

FIG. 3 shows an apparatus similar in its general arrangement to that of FIG. 1, the differences residing in the structure of supporting table 3' and system for delivering surges of compressed air. Table 3' is provided with openings 4' which although they are similar to openings 4 in that they have a width less than the size of the fibers, have the shape of rows of individual slits, for example, extending in the conveying direction, with the slits of each row being spaced from one another in that direction. Support arms 19 are attached by means of pivot joints 20 and 21 to each corner of the rectangular supporting table 3'. Each joint 20 is fixed to a frame 22 of the apparatus while each joint 27 is fastened to move with the supporting table 3'. Arms 19 simultaneously support table 3' and enable it to execute a vibratory movement in the fiber conveying direction, which movement is generated by an eccentric drive 23 having a crank arm connected to the table. Below the supporting table 3', a plurality of mutually parallel units 24 for delivering surges of compressed air are arranged one behind the other in the conveying direction of the textile fiber tufts. These devices are connected to a common compressed air supply line (not shown). The units 24 are fixed to the supporting table, for example by weld joints 24' shown in FIG. 4, and are provided with openings 25 on the side facing the supporting table, through which compressed air is directed toward the fiber tufts through openings 4' in the supporting table 3'.

Figure 5:
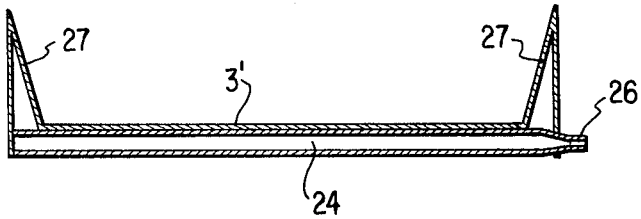
FIG. 5 is a simplified front elevational view of the supporting table of FIG. 3.

FIG. 5 shows the supporting table 3' provided along its sides with upwardly directed walls 27. Below the supporting table 3 are the units 24 for delivering pressure surges. The units 24 are in communication with a common compressed air supply line (not shown) each via a sleeve manifold 26. Since manifold 26 is fixed to units 24 and will vibrate together with table 3' and units 24, the manifold is preferably connected to the supply line by a flexible hose.

It will be understood that the above description of the present invention is susceptible to various modifications, changes and adaptations, and the same are intended to be comprehended within the meaning and range of equivalents of the appended claims.

What is claimed is:

1. A method for cleaning textile fiber tufts comprising: depositing such textile fiber tufts onto the upper surface of a supporting member provided with openings; directing streams of compressed air upwardly through the openings in the member and against the textile fiber tufts by causing compressed air to be discharged periodically from delivery nozzles arranged below the supporting member for propelling the tufts upwardly to release dust therefrom and permit heavy particles to be separated from the tufts and to fall through the openings in the supporting member; and drawing away the released dust by means of a suction device disposed above the supporting member.

2. A method as defined in claim 1 further comprising conveying the textile fiber tufts along the supporting member.

3. Apparatus for cleaning textile fiber tufts, comprising: means defining a supporting member provided with openings having a width less than the size of the tufts; means for delivering textile fiber tufts onto the upper surface of said member; means disposed below said supporting member for directing surges of compressed air toward said supporting member and through said openings, in directions which are oblique to the upper surface of said supporting member; a perforated cover plate disposed to the side of said supporting member to which the tufts are supplied and located at a distance from said supporting member; and means connected to said perforated cover plate for sucking air away from said member.

4. An arrangement as defined in claim 3 wherein said supporting member comprises a supporting table arranged to be vibrated for conveying textile fibers in a direction parallel to its upper surface.

5. An arrangement as defined in claim 4 wherein said means for directing surges of compressed air comprise a plurality of parallel pipes.

6. An arrangement as defined in claim 5 wherein each of said pipes is provided, at the side thereof facing said supporting table, with a plurality of juxtaposed air delivery nozzles spaced along the length of the respective pipe.

7. An arrangement as defined in claim 6 wherein each said nozzle is oriented so that its axis is oblique to the upper surface of said supporting table and all of said nozzles are inclined in the same general direction relative to said supporting table.

8. An arrangement as defined in claim 7 wherein said nozzles are spaced apart in the direction in which textile fibers are conveyed by said supporting table and said nozzles are oriented such that the angle of inclination of the axis of each nozzle to the vertical increases progressively between nozzles in the direction of conveyance of textile fibers by said supporting table.

9. Apparatus for cleaning textile fiber tufts, comprising: means defining a supporting table provided with openings having a width less than the size of the tufts; means for delivering textile fiber tufts onto the upper surface of said table; means attached below said supporting table for directing surges of compressed air toward said supporting table and through said openings; means connected to said supporting table for vibrating said table in a direction generally parallel to its upper surface in order to propel fiber tufts in that direction along the upper surface; and means disposed above said supporting table for sucking air away from said member.

10. An arrangement as defined in claim 9 wherein said means for vibrating causes said table to vibrate at between approximately 40 to 80 vibrations per minute.

11. An arrangement as defined in claim 9 wherein said supporting table is provided with side walls extending upwardly from its upper surface along the sides thereof which are parallel to the direction in which said table vibrates.

12. Apparatus for cleaning textile fiber tufts, comprising: means defining a supporting member provided with an opening having a width less than the size of the tufts; means for delivering textile fiber tufts onto the upper surface of said member; means disposed below said supporting member for directing surges of compressed air toward said supporting member and through said openings, said means for directing surges of compressed air being composed of a plurality of juxtaposed air delivery nozzles arranged to deliver such surges of compressed air in directions which are oblique to the upper surface of said supporting members in order to convey the textile material along the supporting member, said nozzles being spaced apart in the direction in which textile fibers are conveyed and being oriented such that the angle of inclination of the axis of each nozzle to the vertical increases progressively between nozzles in the direction of conveyance of textile fibers along said supporting member; a perforated cover plate disposed to the side of said supporting member to which the tufts are supplied and located at a distance from said supporting member; and means connected to said perforated cover plate for sucking air away from said member.

* * * * *